US006249980B1

(12) United States Patent
Edwards

(10) Patent No.: US 6,249,980 B1
(45) Date of Patent: Jun. 26, 2001

(54) CAN OPENER

(75) Inventor: John Anthony Edwards, Seaford (GB)

(73) Assignee: Mitchell & Cooper Limited (GB)

( * ) Notice: Subject to any disclaimer, the term of this patent is extended or adjusted under 35 U.S.C. 154(b) by 0 days.

(21) Appl. No.: 09/304,739

(22) Filed: May 4, 1999

(30) Foreign Application Priority Data

Nov. 3, 1998 (GB) ..... 9823954
Dec. 29, 1998 (GB) ..... 9828745

(51) Int. Cl.[7] ..... B67B 7/70
(52) U.S. Cl. ..... 30/419; 30/416; 30/434
(58) Field of Search ..... 30/416, 418, 419, 30/433, 434

(56) References Cited

U.S. PATENT DOCUMENTS

| | | | | |
|---|---|---|---|---|
| 528,371 | | 10/1894 | Keller . | |
| 1,537,110 | * | 5/1925 | Edlund | 30/416 |
| 1,713,823 | * | 5/1929 | Edlund | 30/416 |
| 1,974,671 | | 9/1934 | Egan . | |
| 2,619,718 | * | 12/1952 | Landry | 30/419 |
| 3,538,787 | * | 11/1970 | Briar et al. | 30/419 |
| 3,688,398 | * | 9/1972 | Aberer | 30/419 |
| 3,688,400 | * | 9/1972 | Aberer et al. | 30/419 |
| 4,651,962 | | 3/1987 | Helgesson . | |
| 4,652,243 | | 3/1987 | Crosslen | 30/448 |
| 4,689,886 | | 9/1987 | Bernazzani et al. | 30/433 |
| 5,052,110 | | 10/1991 | Bartlett | 30/434 |

FOREIGN PATENT DOCUMENTS

| | | | |
|---|---|---|---|
| 986574 | 3/1951 | (FR) . | |
| 15696 | 11/1907 | (GB) . | |
| 259410 | 10/1926 | (GB) . | |
| 274531 * | 5/1930 | (IT) | 30/415 |

* cited by examiner

*Primary Examiner*—Hwel-Slu Payer
(74) *Attorney, Agent, or Firm*—Bryan Cave LLP; Stephen P. Gilbert

(57) ABSTRACT

A can opener has a blade-carrying member pivotably connected to a housing and a hooked connection between the blade-carrying member and the housing that permits the blade-carrying member to be disconnected from the pivotal connection when an actuator of the can opener is moved to a release position. The can opener may be provided with a stop to prevent the disconnection and removal of the blade-carrying member unless the actuator is in the release position.

25 Claims, 13 Drawing Sheets

CAN OPENER

TECHNICAL FIELD OF THE INVENTION

The present invention relates to can openers and in particular, though not exclusively, to can openers for use in catering establishments.

BACKGROUND OF THE INVENTION

A typical can opener, shown in FIG. 1, comprises an operating handle 2, a housing 4, and a blade 6 carried by a blade carrying member 8, which in turn is pivotally connected to the housing 4. A stem or post (not shown) extends from the housing 4 into a sleeve 10 connected to a table or work surface 12. In use, a can 14 is gripped between the blade 6 and a drive wheel (not shown) connected via a spindle to the operating handle 2. Rotation of the operating handle 2 causes the can 14 to be rotated against the blade 6. The pivotal connection between the member 8 and the housing 4 is necessary to enable the can 14 to be fitted to, and subsequently removed from, the can opener. The pivotal connection is achieved by a pin 16 fixed in the housing 4 passing through a hole in the member 8.

It is imperative in a catering establishment that all utensils be kept clean so as to prevent the cultivation and transmission of germs and bacteria. Can openers of the type described above have been found difficult to clean as the member 8 is not intended to be removed from the pin 16. Particularly at risk is the blade 6 which comes into direct contact with the contents of the opened cans. If the blade 6, and the adjacent blade carrying member 8 to which it is attached, are left unwashed then both germs and bacteria can accumulate and transfer to the contents of other cans.

U.S. Pat. No. 5,052,110 describes a can opener wherein the fixed pin 16 is replaced by a removable pull pin. Removal of the pull pin allows the blade carrying member to be removed from the housing to permit cleaning thereof. Problems exist with this arrangement whereby loss or breakage of the pull pin renders the can opener unusable. In addition, repeated removal and refitting of the pull pin can lead to wear of the pin and/or the housing with the result that the pin is liable to work loose during the normal operation of the can opener. This can affect the operation of the can opener and possibly lead to the pull pin and/or blade carrying member falling into a can when said can is in the process of being opened.

SUMMARY OF THE INVENTION

The present invention thus provides a can opener from which the blade carrying member can be removed easily to allow cleaning thereof. Removal is effected by moving the actuation means provided for the normal operation of the can opener to a release position; this thereby eliminates the need to at least partially disassemble the can opener prior to removal of the blade carrying member. The need for special tools or skills to effect removal of the blade carrying member is also eliminated.

DETAILED DESCRIPTION OF THE INVENTION

According to a first aspect of the present invention there is provided a can opener operable in use to rotate a container relative to a blade of the can opener, the can opener comprising a housing, a blade-carrying member releasably connected to the housing and pivotable relative thereto, and actuation means for pivoting the blade-carrying member and for rotating a container, wherein a hooked connection is provided between the blade-carrying member and the housing, the hooked connection being separable so as to enable the blade-carrying member to be removed from the housing when the actuation means is moved to a release position.

The hooked connection comprises a hook on one of the housing and blade carrying member and a pin or axle of the other of the housing and blade carrying member. In a preferred embodiment the blade carrying member is provided with a hook and the housing with a pin. In an alternative embodiment the blade carrying member may be provided with one or more axles and the housing with slots adapted to receive the axle or each of the axles.

Preferably the can opener is provided with stop means to prevent the separation of the hooked connection unless the actuation means is in the release position. The stop means may comprise a projection on one of the housing and blade carrying member and a recess in the other of the housing and blade carrying member. In a preferred embodiment the projection and recess are provided on the blade carrying member and housing respectively. In such an embodiment the projection is preferably positioned opposite the open side of the hook. During normal operation of can opener the projection is received in the recess and thus prevents movement of the blade carrying member relative to the housing in a direction leading to separation of the hooked connection. When the actuation means is moved to the release position the projection is moved out of the recess and separation of the hooked connection is then possible.

The actuation means may comprise a handle pivotably connected to a spindle and having a cam surface at said pivotal connection, a cam follower, a spring and a drive wheel. The drive wheel is connected to the spindle and is rotatable by the handle. In a preferred embodiment the spindle passes through the cam follower and the spring, the spring, in use, being provided between a seat in the housing and seat on the cam follower. The cam follower may have a substantially hollow centre and an opening into which a portion of the blade carrier can project, in use. The spring may project into the hollow centre of the cam follower. In such an embodiment, the portion of the blade carrying member projecting into the cam follower may be shaped so as to fit around the spring. The cam follower may include a recess shaped to receive the stopping means projection of the blade carrying member.

The can opener preferably also includes a post extending from the housing, said post being slidable in a sleeve attached to a work surface, table or the like.

According to a second aspect of the present invention there is provided a can opener operable in use to rotate a container relative to a blade of the can opener, the can opener comprising a housing, a blade carrying member releasably connected to the housing and pivotable relative thereto about a pin or the like fixed to the housing, and actuation means operable to pivot said blade carrying member and to rotate a container, wherein the blade carrying member is releasable from the housing without removal of the pin therefrom.

According to a third aspect of the present invention there is provided a can opener as hereinbefore described with reference to the first or second aspect, the actuation means of the can opener having a cam follower engageable with the blade carrying member, the cam follower being movable by a cam surface of the actuation means to effect pivotal movement of the blade carrying member relative to the housing.

In a preferred embodiment the cam follower is annular. The cam follower may be substantially cylindrical.

According to a fourth aspect of the present invention there is provided a can opener operable in use to rotate a container relative to a blade of the can opener, the can opener comprising a housing, a blade carrying member releasably connected to the housing and pivotable relative thereto, and actuation means operable to pivot said blade carrying member and to rotate a container, the actuation means including a cam follower engageable with the blade carrying member and a spring, the cam follower being movable by a cam surface of the actuation means to effect pivotal movement of the blade carrying member relative to the housing, and the spring being provided between the cam follower and the housing, wherein a hooked connection is provided between the blade carrying member and the housing, said hooked connection being separable so as to enable the blade carrying member to be removed from the housing when the actuation means is moved to a release position.

BRIEF DESCRIPTION OF THE DRAWINGS

The present invention will now be described with reference to the accompanying drawings.

DETAILED DESCRIPTION OF THE DRAWINGS

Figure 1:
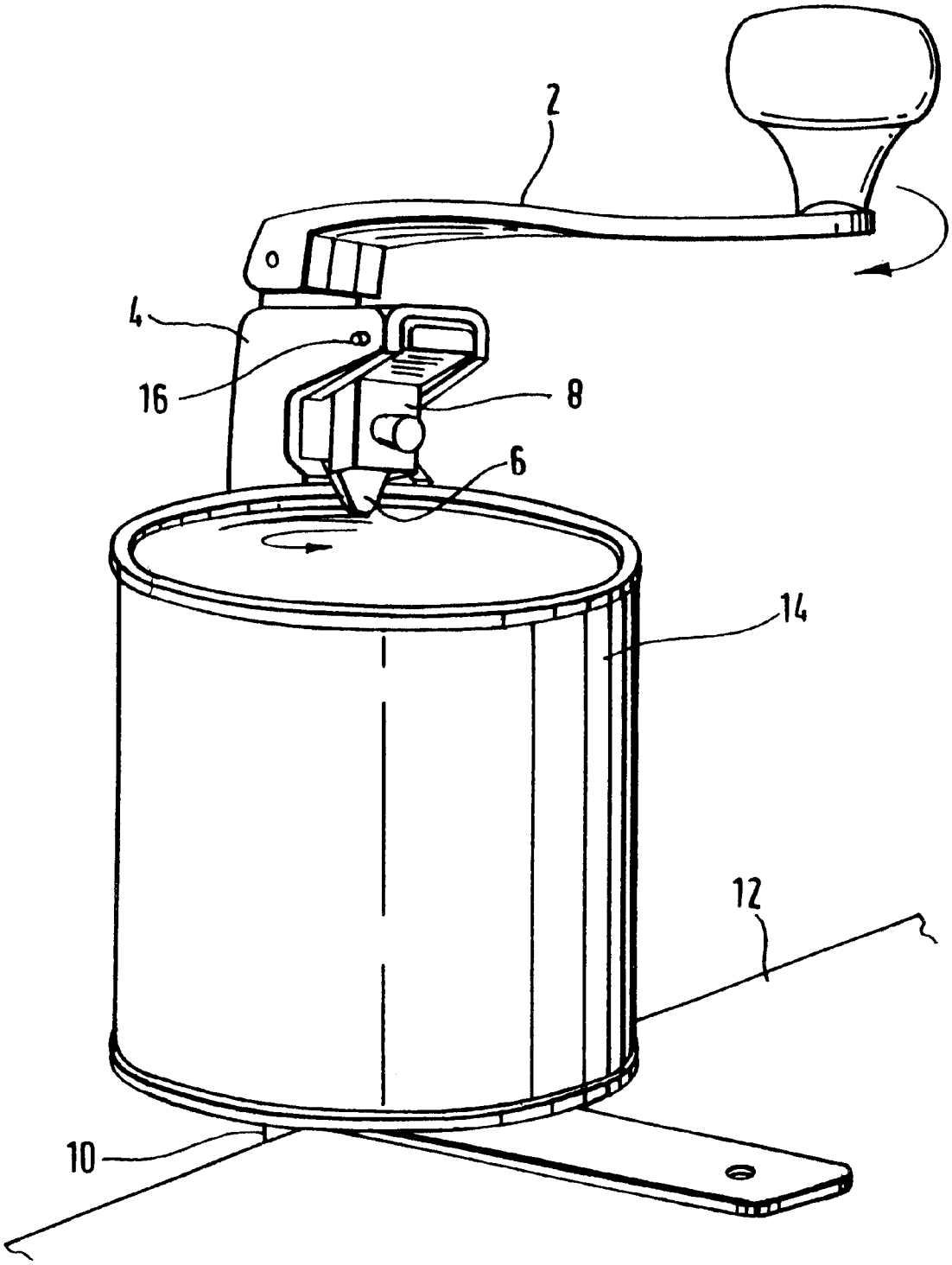
Fig.1. PRIOR ART
FIG. 1 shows a perspective view of a prior art can opener.

A can opener 20 according to an embodiment of the present invention is shown in FIGS. 2 to 6. The can opener 20 comprises an operating handle 22, a housing 24, a blade 26 and a blade carrying member 28. The operating handle 22 has a first end 30 with a rotatable grip button 32, and a second end 34 which is pivotally connected to a spindle 36 by a pivot pin 50. The second end 34 is provided with a cam surface 48. The spindle 36 is supported for rotation about an axis 42 in the housing 24 by a bush 38. Attached to the spindle 36 is a drive wheel 40 which protrudes through an opening 68 adjacent the blade 26 in a lower portion of the housing 24. It will be understood that rotation of the operating handle 22 about the axis 42 causes rotation of the spindle 36 and drive wheel 40. As described above the drive wheel 40 in use moves a can relative to the blade 26. To achieve this the drive wheel 40 has an outer edge 44 which is adapted to grip the can. Typically this edge 44 is provided with teeth or ribs 41.

Figure 2:
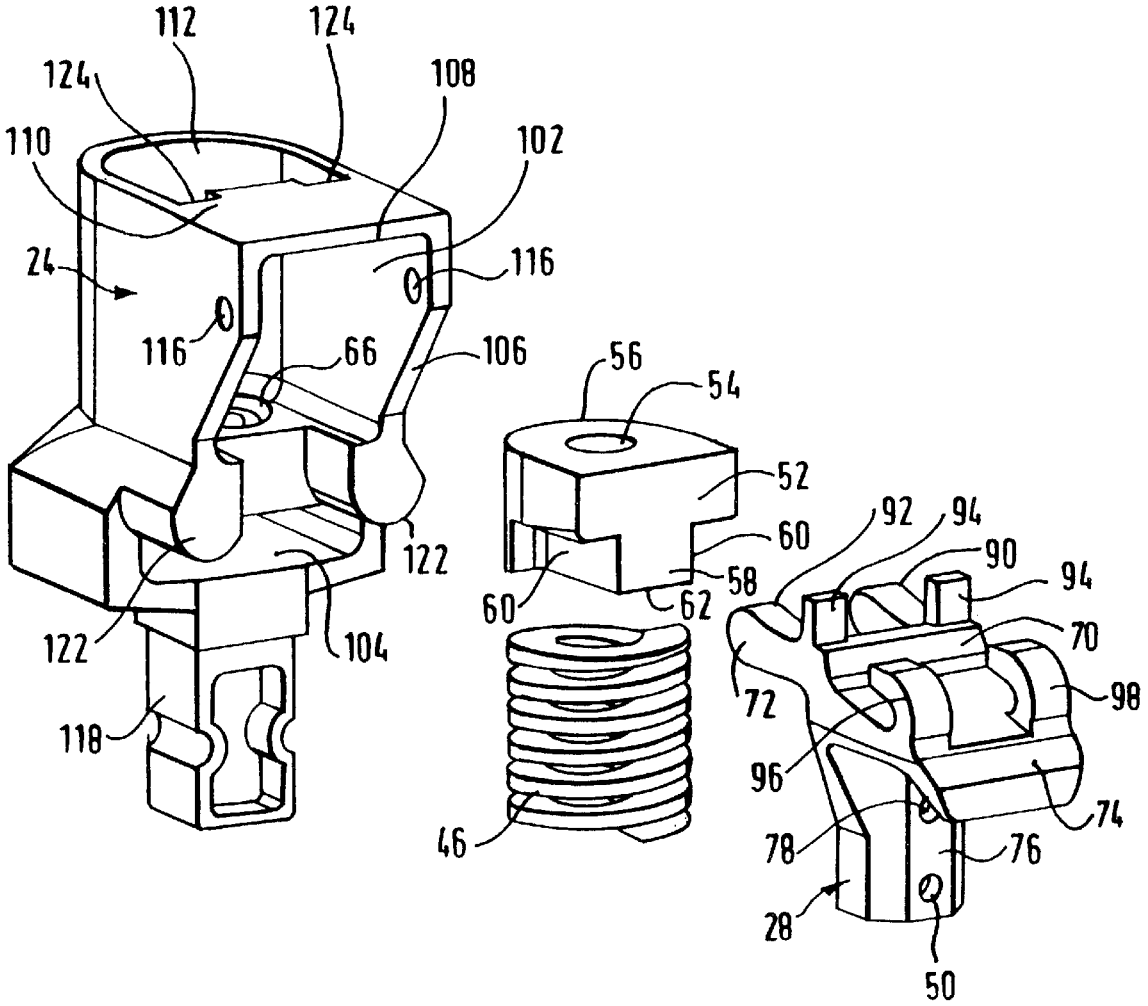
FIG. 2 shows an exploded perspective view of components of a can opener according to a first embodiment of the present invention.

Between the bush 38 and the second end 34 of the operating handle 22 there is provided a helical spring 46 and a cam follower 52. The spindle 36 passes through an aperture 54 in the cam follower 52 and through the centre of the helical spring 46. The cam follower 52 is substantially D-shaped when viewed from above and has a flat upper surface 56 upon which the cam surface 48 of the operating handle 22 acts, in use. A lower portion 58 of the cam follower 52 is undercut so as to provide a pair of recesses 60 into which portions of the blade carrying member 28 are received, in use. The spring 46 is provided between the lower surface 62 of the cam follower 52 and the bush 38. As shown in FIGS. 3 to 6 the bush 38 may be provided with a flange 64 which acts as a spring seat or alternatively, and as shown in FIG. 2, a recess 66 may be provided in the housing 24 above the bush 38 to locate the spring 46.

The blade carrying member 28 is substantially T-shaped and has a cross member 70 with a first end 72 adapted to fit to the recesses 60 of the cam follower 52, and a second end 74 adapted to be releasably attachable to the housing 24. An arm 76 to which the blade 26 is fixable extends from the cross member 70. In the embodiment shown the arm 76 is formed with two through holes 78, 80. The blade 26 is attached to the arm 76 by screw type fasteners 82 passing through the holes 78, 80 and locating in corresponding threaded apertures 84, 86 of the blade 26. The arm 76 may be formed with a blade recess 88 into which the blade 26 is received, and which serves to align the blade apertures 84, 86 with the arm holes 78, 80.

The first end 72 of the cross member 70 is provided with two spaced fingers 90, 92 which, in use locate in the cam follower recesses 60. At the base of each finger 90, 92 there is provided an upstanding stop 94. The second end 74 of the cross member 70 is provided with two hooks 96, 98 which, in use, enable the blade carrying member 28 to be connected to the housing 24.

As can be seen from the accompanying drawings the housing 24 serves to accommodate the blade carrying member 28, the spindle 36, the bush 38, the wheel 40, the cam follower 52 and the spring 46. The bush 38 fits to a correspondingly shaped aperture 100, while the blade carrying member 28, cam follower 52 and spring 46 are accommodated in an upper cavity 102. The wheel 40 is accommodated in a lower cavity 104. The upper cavity 102 is surrounded by a wall 106 and has an opening 108 at one side thereof. The housing 24 has a roof 110 with a cut out portion 112 shaped to correspond substantially to the plan-view shape of the cam follower 52. The cut out portion 112 includes recesses 124 at one side thereof which correspond substantially to the cross-sectional shape of the upstanding stops 94 of the blade carrying member 28. A pin 114 is provided in the upper cavity 102 across the opening 108. The pin 114 is fixed within aligned apertures 116 of the housing 24. In use the hooks 96, 98 of the blade carrying member 28 are engageable with the pin 114 to provide a hooked connection 117. The housing 24 further includes a spigot 118 to enable it to be attached to a post 120, and wear resistant abutment portions 122 against which the edge of the can moves in use.

Figure 3:
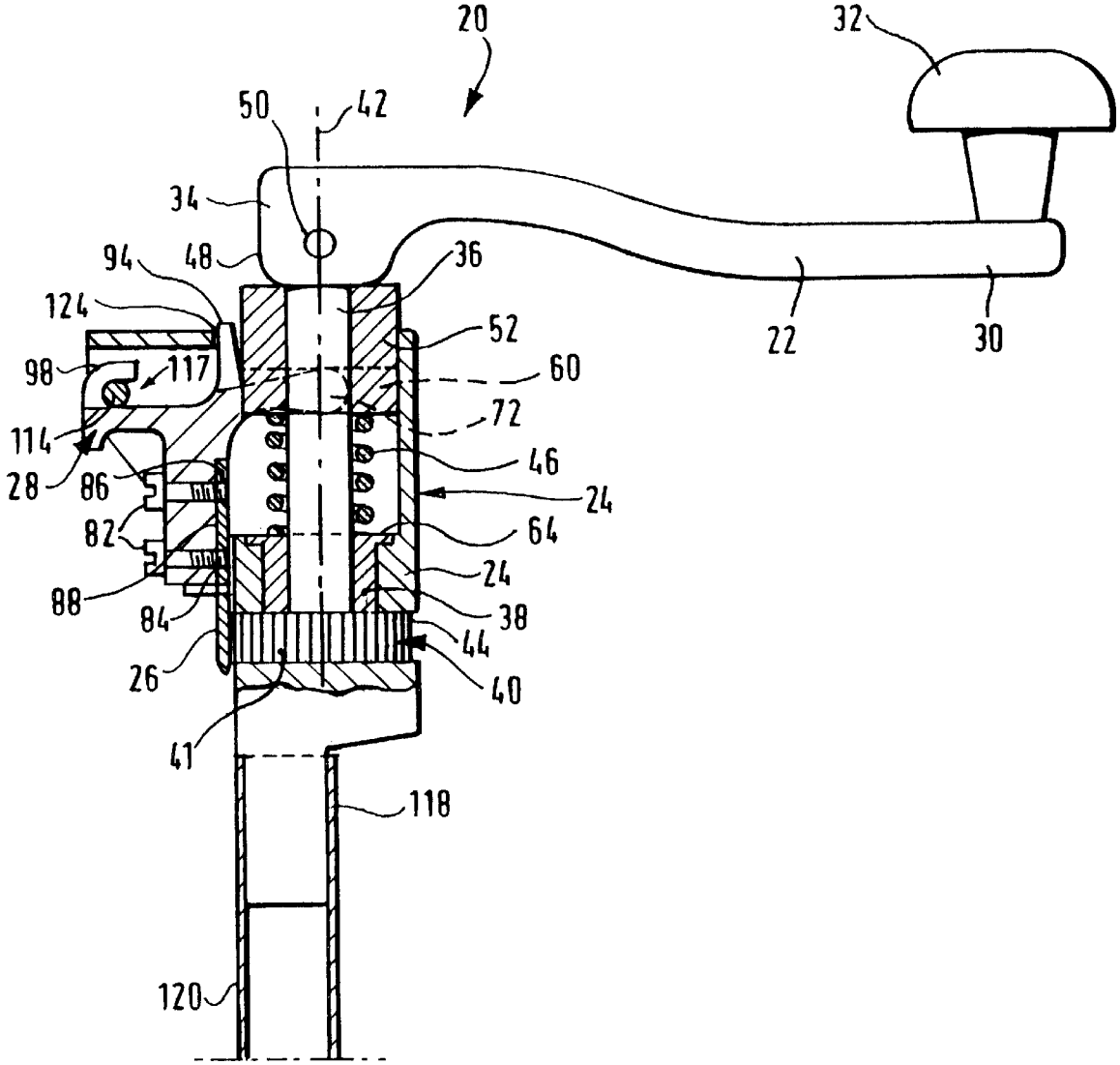
FIGS. 3 to 6 show cross-sectional side views of the can opener of FIG. 2.
Figure 4:
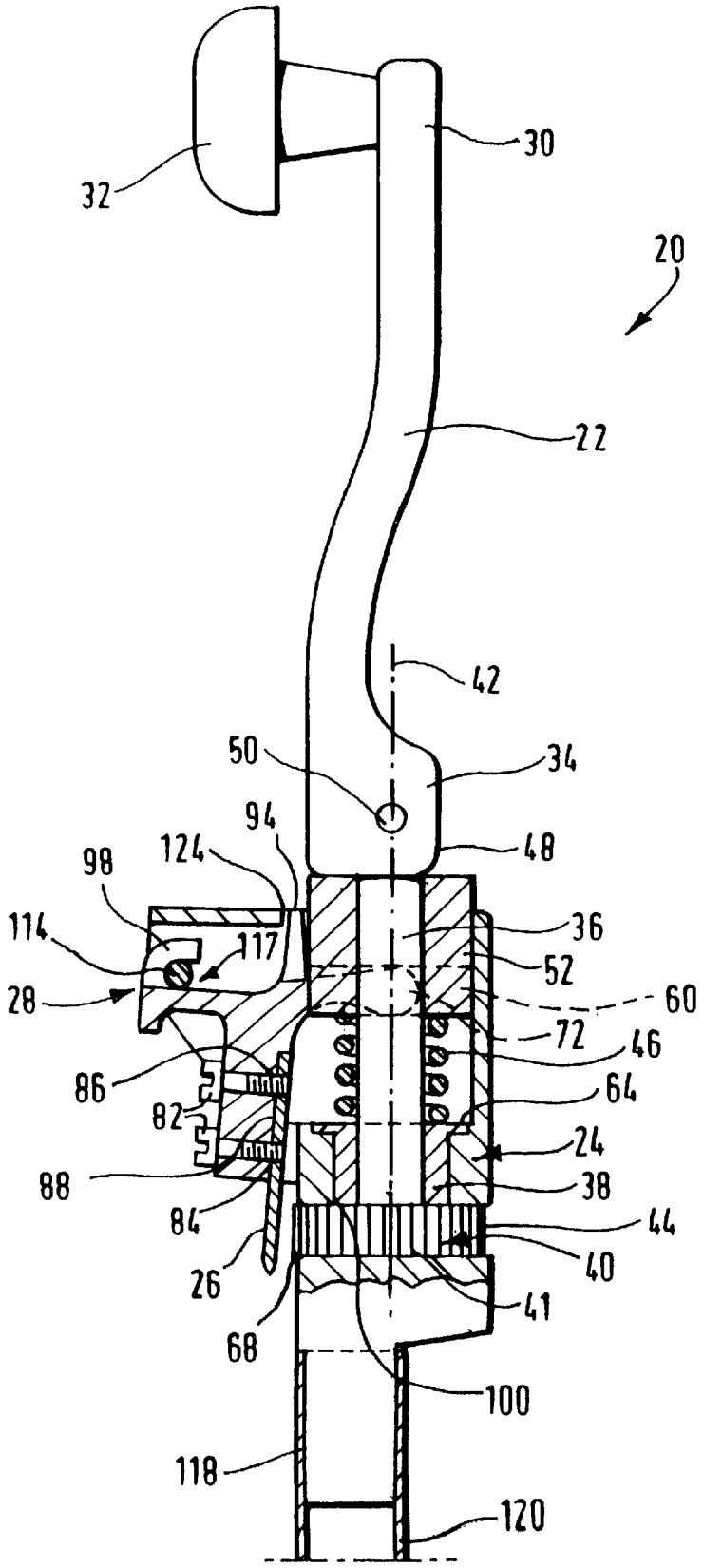

The can opener 20 in its assembled form can be seen in FIGS. 3 and 4. The operating handle 22 is drivably connected to the spindle 36, which in turn is supported for rotation in the housing 24 by the bush 38 and the aperture 54 in the cam follower 52. An upper portion of the cam follower 52 projects through the cut out portion 112 of the housing roof 110. The wheel 40 is drivably connected to the spindle 36 and the edge 44 thereof projects through the opening 68 defined by the lower cavity 104. The blade carrying member 28 is pivotally connected to the housing 24 by the hooked connection 117, while the fingers 90, 92 of the blade carrying member 28 are received in the recesses 60 of the cam follower 52. The upstanding stops 94 of the blade carrying member 28 project into the cut out portion recesses 124.

As shown in FIGS. 3 and 4 the operating handle 22 can be pivoted between an upright position and a substantially horizontal position. It will be noted that in the upright position the distance between the pivot pin 50 and the cam surface 48 is greater than when the operating handle 22 is in the horizontal position. Accordingly, when the operating handle 22 is in the upright position, the cam surface 48 pushes the cam follower 52 into the upper cavity 102 and compresses the spring 46. Movement of the cam follower 52 causes the blade carrying member 28 to pivot about the pin 114. This is due to the fingers 90, 92 of the blade carrying member 28 being engaged in the recesses 60 of the cam follower 52. With the operating handle 22 in the upright position the blade 26 is held away from the wheel 40 and the can opener 20 can be positioned relative to a can such that blade 26 pierces the can. Subsequent movement of the operating handle 22 from the upright position to the horizontal position results in the can lip being clamped between the blade 26 and the wheel 40. Rotation of the operating handle 22 about the axis 42 results in rotation of the wheel 40 and consequently rotation of the can against the blade 26. By pivoting the operating handle 22 back to the upright position the can lip is released and the can opener 20 can be removed.

In both the upright and horizontal operating handle 22 positions the upright stops 94 of the blade carrying member 28 project into their respective recesses 124. Accordingly the blade carrying member 28 is restricted to pivotal movement about the pin 114 and cannot be moved so as to disengage the hooks 96, 98 from the pin 114. Any attempt to move the blade carrying member 28 so as to disengage the hooks 96, 98 from the pin 114 is resisted by the upstanding stops 94 coming into contact with the edge of the cut out portion 112.

Figure 5:
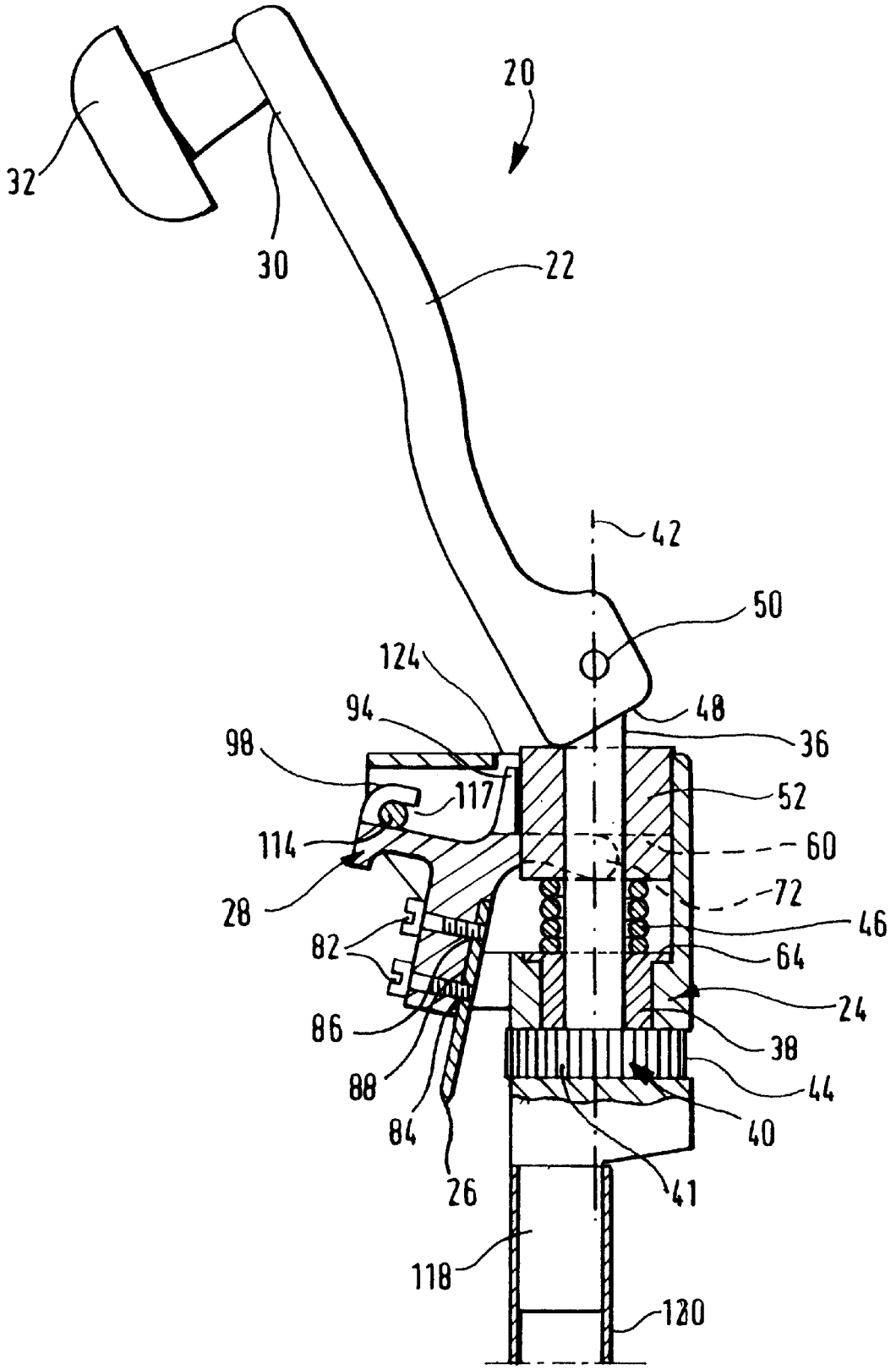

Removal of the blade carrying member 28 is effected by moving the operating handle 22 firstly to the upright position and then pivoting it over-centre as shown in FIG. 5.

Figure 6:
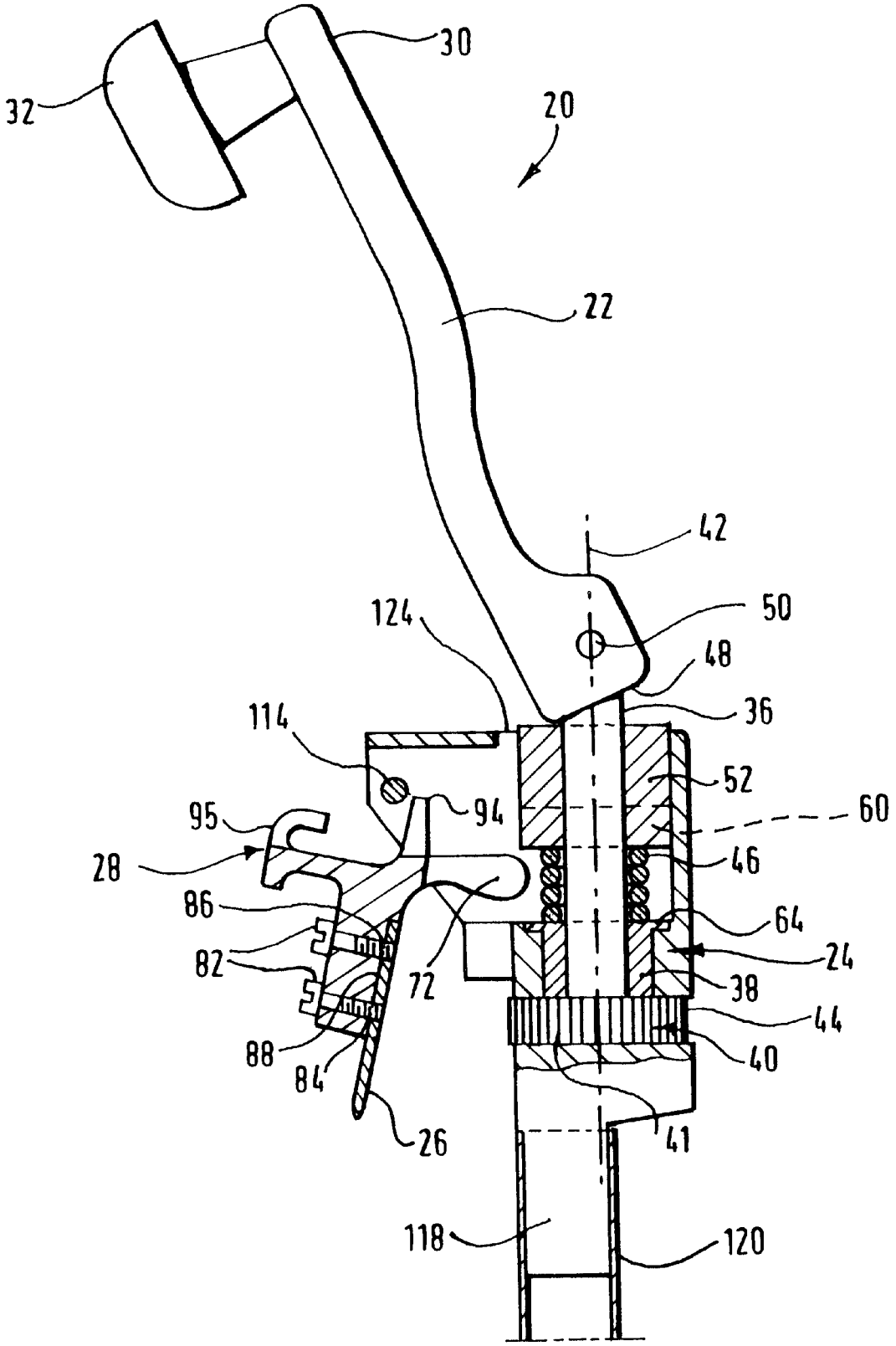

Over-centre movement of the operating handle 22 further increases the distance between the pivot pin 50 and the cam surface 48. This results in the cam follower 52 being pushed further into the upper cavity 102, the spring 46 being further compressed, and consequent additional pivotal movement of the blade carrying member 28. Sufficient over centre movement of the operating handle 22 results in the blade carrying member 28 being pivoted to such an extent that the upstanding posts 94 are moved clear of their recesses 124. The blade carrying member 28 can then be disengaged from the pin 114 and withdrawn from the upper cavity 102 as shown in FIG. 6.

Once the blade carrying member 28 has been removed, the blade 26, blade carrying member 28 and upper cavity 102 can be cleaned. The screw type fasteners 82 can be removed and the blade 26 easily separated from the blade carrying member 28. Refitting of the blade carrying member 28 is achieved by reversing the steps described above.

Figure 7:
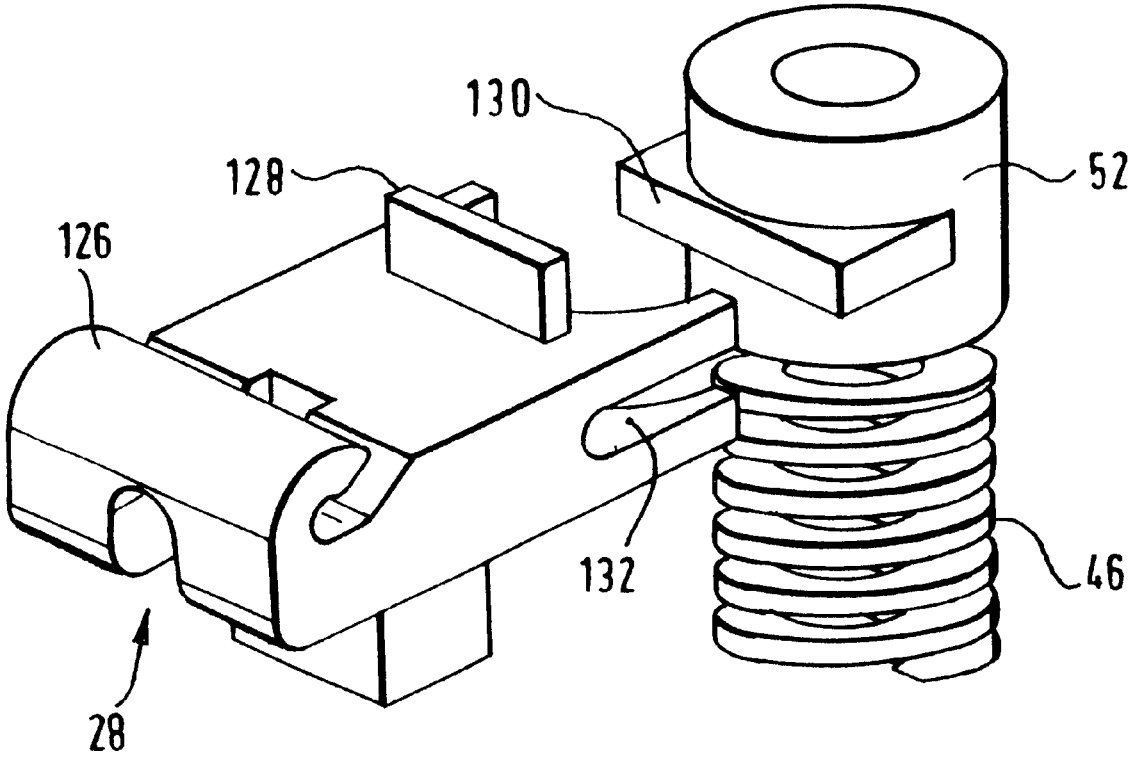
FIG. 7 shows a perspective view of an alternative spring, cam follower and blade carrying member arrangement according to a second embodiment of the present invention.
Figure 8:
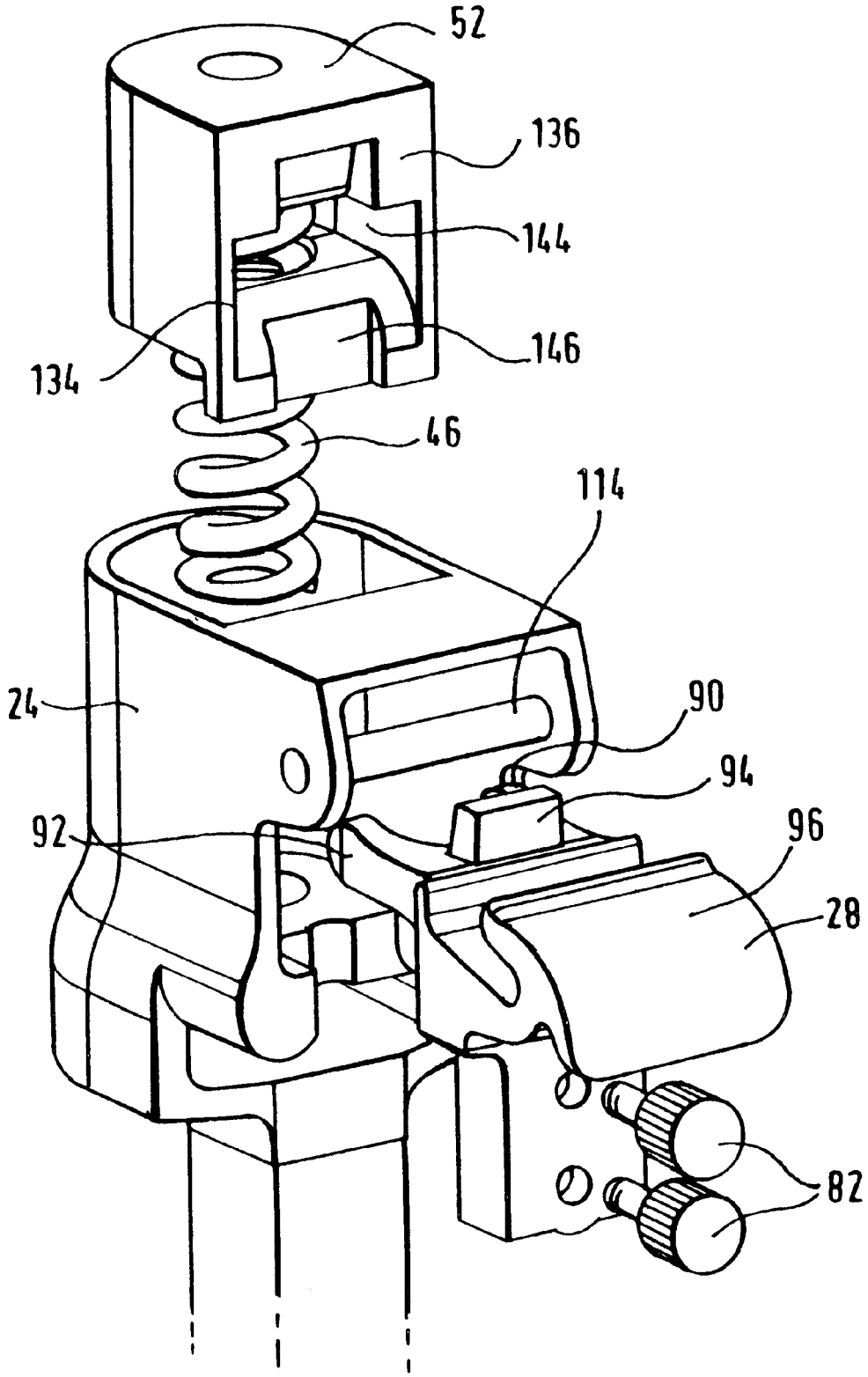
FIG. 8 shows an exploded perspective view of another alternative spring, cam follower and blade carrying member arrangement according to a third embodiment of the present invention.

In the embodiment described the blade carrying member 28 is provided with a pair of hooks 96, 98. It is envisaged that in alternative embodiments the blade carrying member may be provided with a single hook. Such a hook may be centrally positioned between opposing sides of the blade carrying member, or alternatively may extend fully across the blade carrying member. The blade carrying member 28 shown in FIG. 7 has a single hook 126 and a single upstanding stop 128. The pin 114 may be replaced by opposing stub axles which project into the upper cavity 102 from opposing sides of the cavity wall 106. In yet a further embodiment the blade carrying member 28 may be provided with stub axles which locate in slots provided in the cavity wall 106.

To reduce manufacturing costs it is envisaged that the blade carrying member 28 be injection moulded from a plastics material. In such an embodiment the blade 26 may be incorporated into the blade carrying member 28 during the moulding process.

Referring again to FIG. 7 there is shown an alternative arrangement for engaging the blade carrying member 28 with the cam follower 52. Here the cam follower 52 is provided with a projection 130 which is received in a slot 132 provided in the blade carrying member 28. On either side of the slot 132 the blade carrying member 28 is shaped so as to correspond with the shape of the cam follower 52.

Referring now to FIGS. 8 to 11 there is shown an alternative cam follower 52, stop 94 and spring 46 arrangement. Components common to the previously described examples will be identified with like numerals. In the arrangement shown the blade carrying member 28 has a single hook 96 (FIGS. 8, 10, and 11) and a single upstanding stop 94 positioned midway between the arms 90, 92. The cam follower 52 is, as before, substantially D-shaped when viewed in plan and is adapted to receive the arms 90, 92 of the blade carrying member 28 in use. However, instead of having a recessed under surface, the centre 144 cam follower 52 is substantially hollow and has an opening 134 in a side face 136 thereof through which the arms 90, 92 can project. The spring 46 is longer and has a smaller external diameter than that shown in the previously described example. The spring 46 projects into the hollow centre 144 of the cam follower 52 via an aperture 138 in its base 140 and rests against a seat 142 in the cam follower 52. The cam follower 52 is further provided with a recess 146 in the side face 136 into which the stop 94 is received in use.

Figure 9:
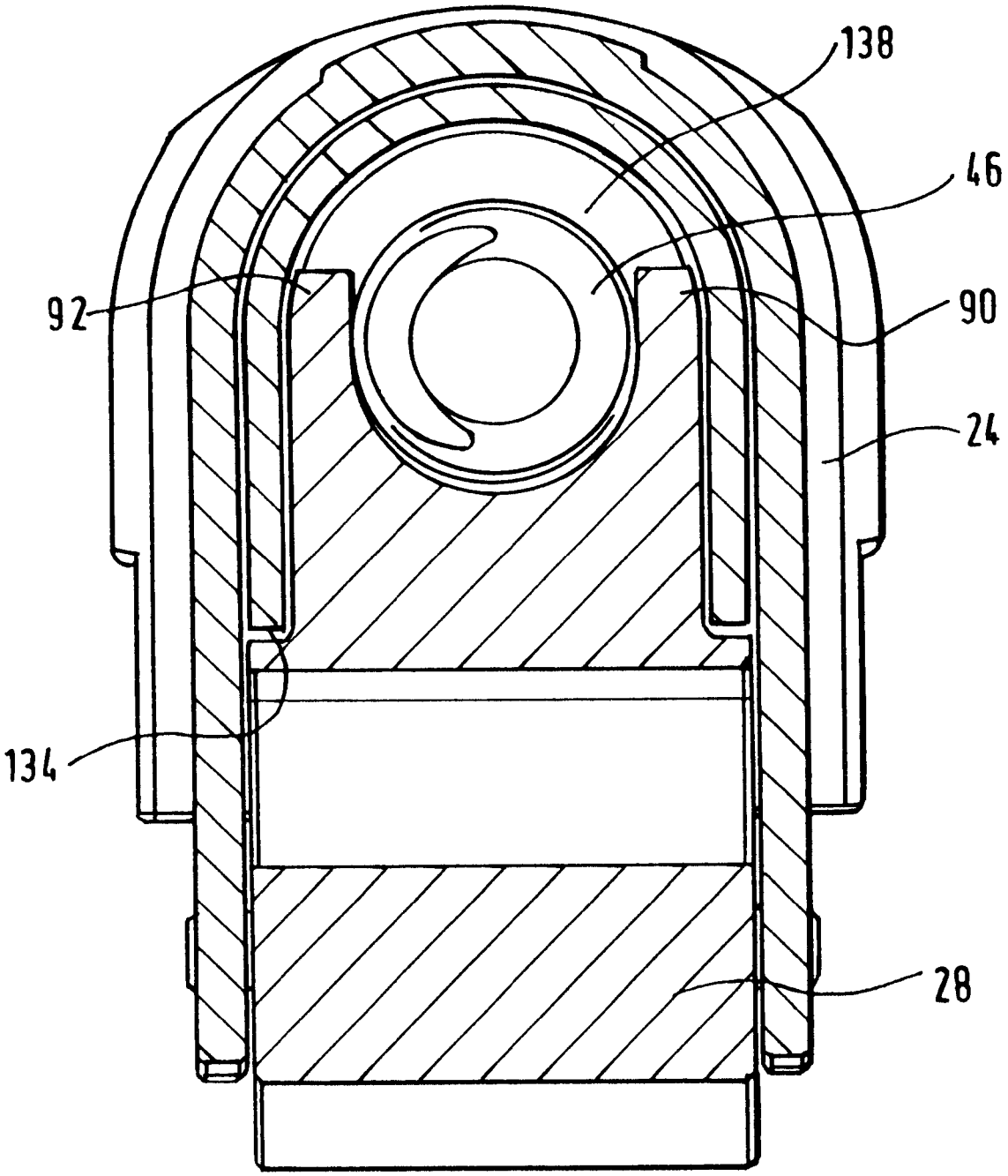
FIG. 9 shows the cross-sectional view indicated by arrows A—A of FIG. 10.
Figure 10:
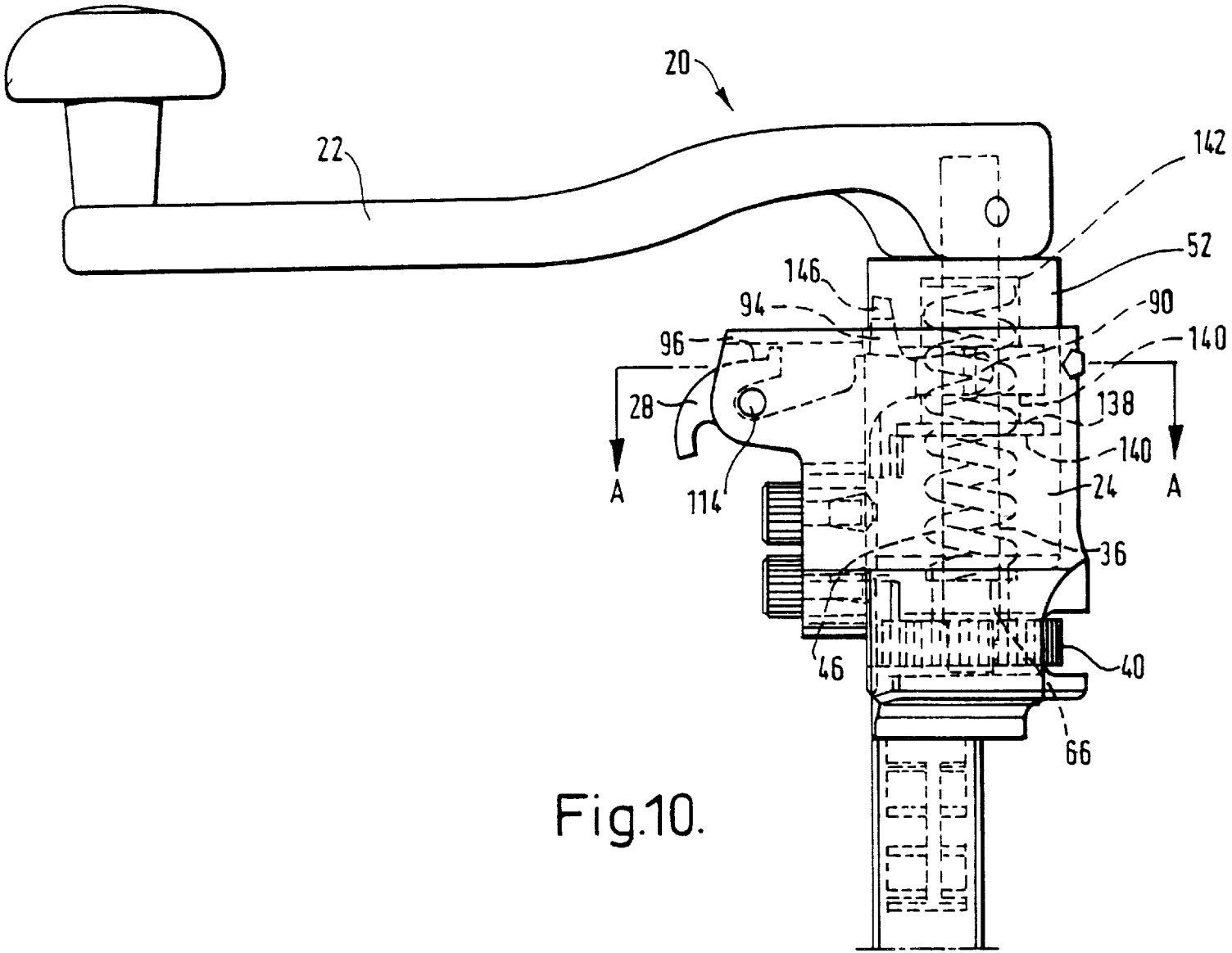
FIG. 10 shows an assembled side view of the arrangement of FIG. 8.

FIGS. 9 and 10 show an assembled can opener 20. The blade carrying member 28 is pivotally attached to the housing 24 by the pin 114 and the arms 90, 92 project into the centre 144 via the opening 134. The spring is positioned between the seat 66 in the housing 24 and the cam follower seat 142, and passes between the arms 90, 92 of the blade carrying member 28. The stop 94 lies in the recess 146 of the cam follower 52.

The longer spring 46 means that a spring with a lower spring rate can be used with the result that operation of the can opener 20 is made easier. In the can opener 20 of the present invention, the cam follower 52 and spring 46 need to be compressed further into the housing 24 to enable removal of the blade carrying member than is required during normal operation. Typically the stroke length during normal operation is in the region of 3 mm, whereas a stroke of around 9 mm is required to enable the blade carrying member 28 to be released. The use of a longer spring may also make the can opener easier to assemble by reducing the force which has to be overcome when the spindle 36 is connected to the drive wheel 40, for example by the use of complementary screw threads on each component.

Figure 11:
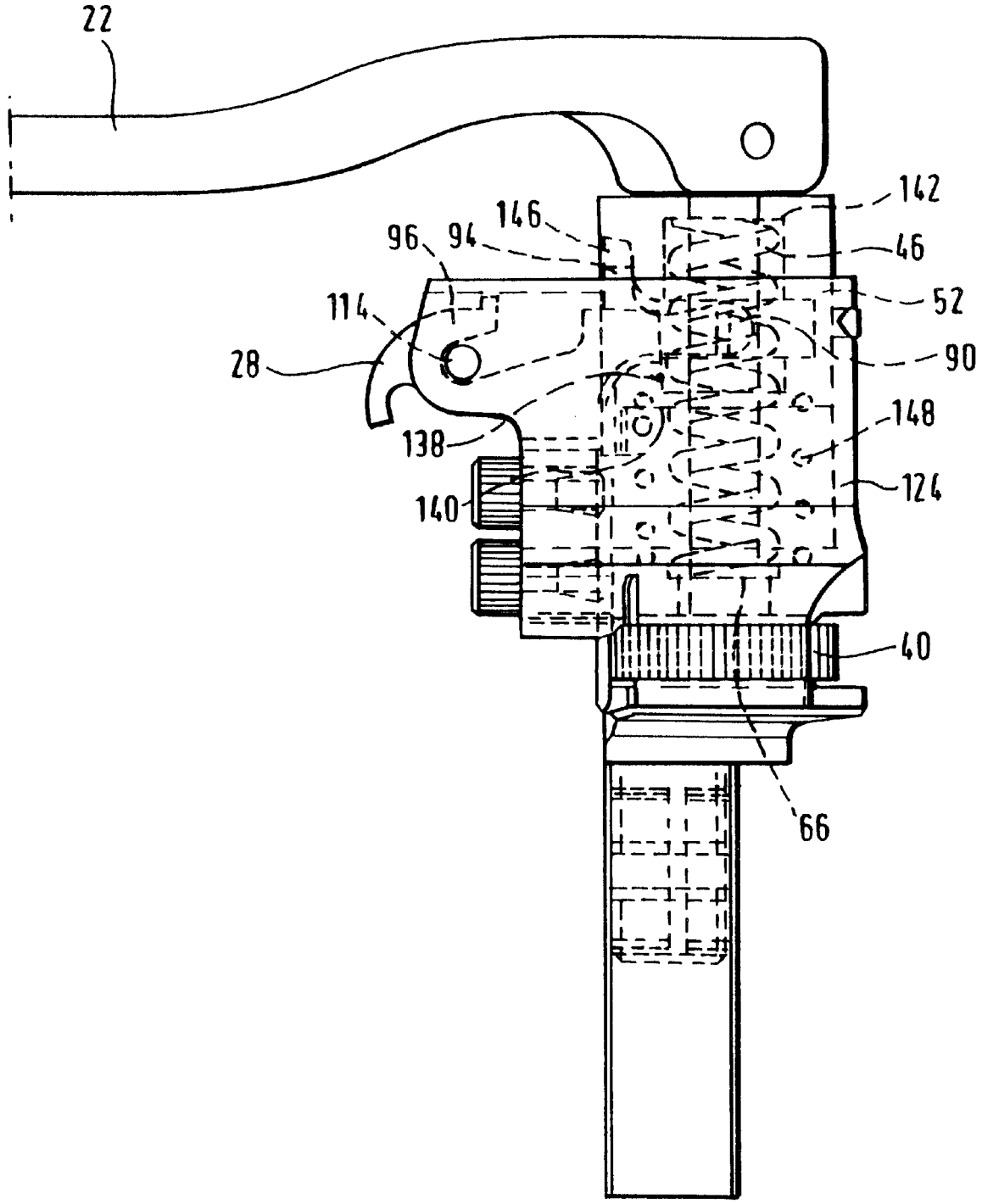
FIG. 11 shows an assembled side view of a can opener having an additional spring.
Figure 12:
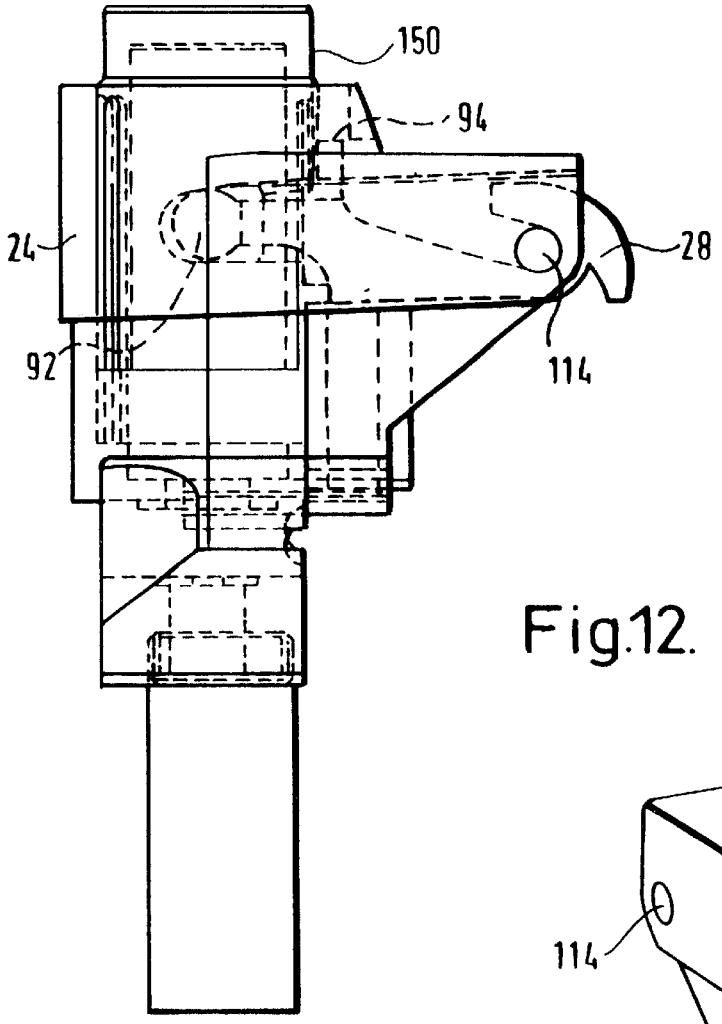
FIG. 12 shows a side view of a can opener according to a fourth embodiment of the present invention.
Figure 13:
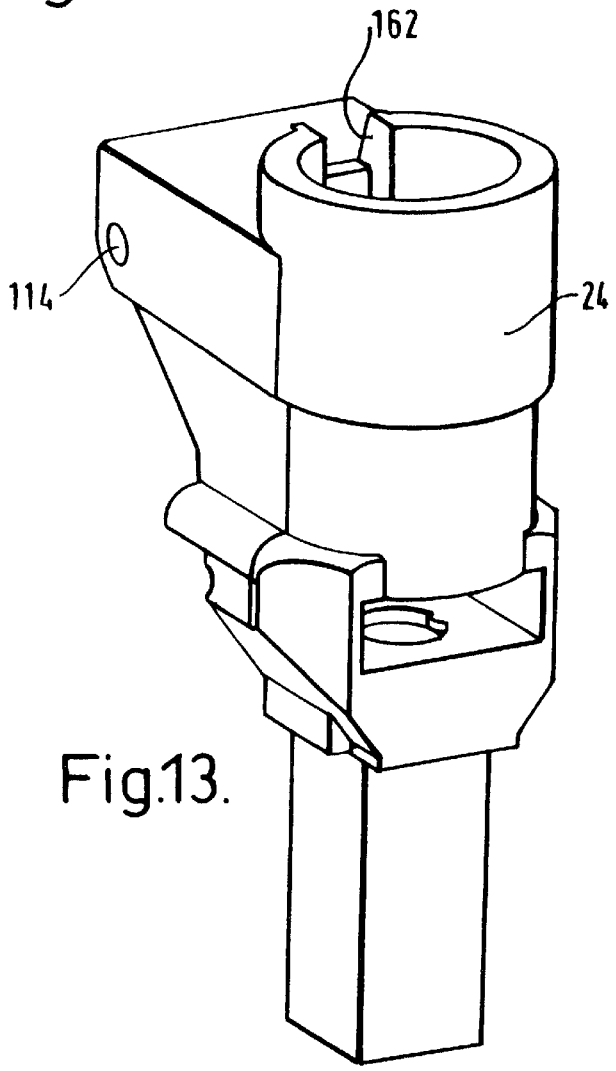
FIG. 13 shows a perspective view of the housing of the can opener of FIG. 12.
Figure 14A:
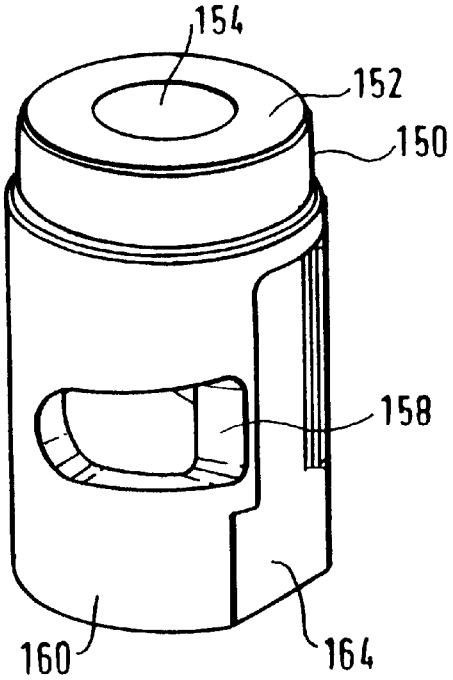
FIGS. 14A to 14C show perspective, side and front views respectively of the cam follower of the can opener of FIGS. 12 and 13.
Figure 14B:
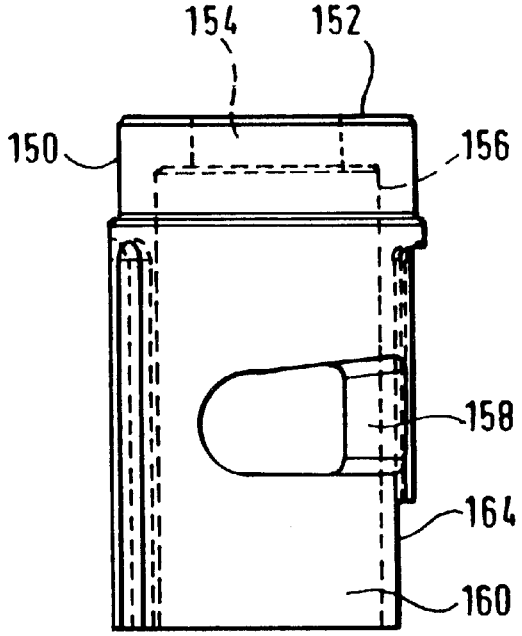
Figure 14C:
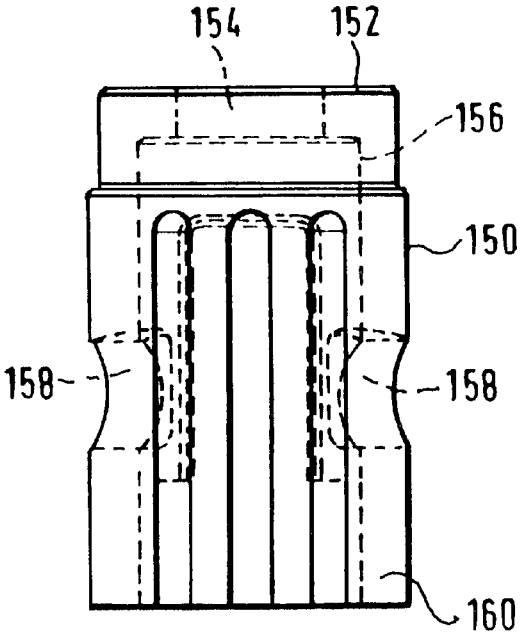

FIG. 11 shows a further example of a can opener 20 having the cam follower 52, stop 94 and spring 46 arrangement described above and including an additional spring 148. The additional spring 148 is provided concentrically about the other spring 46 and is positioned in a lower portion of the housing 24 below the cam follower 52. The use of an additional spring 148 increases the clamp force between the drive wheel 40 and the blade 26. An increase in clamp force increases the traction between the drive wheel 40 and the can and hence reduces the possibility of the drive wheel 40 slipping.

Referring now to FIGS. 12 to 14C there is shown a can opener having a further alternative cam follower and stop arrangement. As before, components common to the previously described examples will be described with like numerals. In the embodiment shown, the cam follower takes the form of an inverted cup 150, the interior of which is adapted to receive the spring (not shown). The base 152 of the cup 150 is provided with a hole 154 through which the spindle projects, in use, and a seating surface 156 for the spring is provided around the hole 154. Aligned slots 158, which are adapted to receive the arms 90, 92 of the blade carrying member 28, are provided in the wall 160 of the cup 150. The blade carrying member 28 is provided with a single upstanding stop 94 positioned substantially midway between the arms 90, 92. When the blade carrying member 28 is fitted to the housing 24, the stop 94 is received in a recess 162 of the housing 24. The portion of the wall 160 of the cam follower 150 facing the recess 162 is flattened 164 to accommodate the stop 94 of the blade carrying member 28. The can opener is operated substantially as hereinbefore described with reference to the previous embodiments. Overcentre movement of the operating handle depresses the cam follower 150 into the housing 20 and pivots the blade carrying member 28. Sufficient overcentre movement of the operating handle moves the stop 94 clear of the recess 162 and permits the blade carrying member 28 to be disengaged from the pin 114.

The inverted cup cam follower 150 can be manufactured from a plastics material, for example by injection moulding, and allows a relatively long spring to be used. As noted above, the use of a longer spring with a lower rate reduces the spring force which has to be overcome when moving the operating handle overcentre.

What is claimed is:

1. A can opener operable in use to rotate a container relative to a blade of the can opener, the can opener comprising a housing, a blade-carrying member releasably connected to the housing and pivotable relative thereto, and actuation means for pivoting the blade-carrying member and for rotating a container, wherein a hooked connection is provided between the blade-carrying member and the housing, the hooked connection being separable so as to enable the blade-carrying member to be removed from the housing when the actuation means is moved to a release position so that the blade-carrying member can be removed from the actuation means; the can open further comprising stop means to prevent the separation of the hooked connection unless the actuation means is in the release position, wherein the stop means comprise a projection on one of the housing and the blade-carrying member and a recess in the other of the housing and the blade-carrying member.

2. A can opener as claimed in claim 1 wherein the hooked connection comprises a hook on one of the housing and the blade-carrying member and a pin or axle of the other of the housing and the blade-carrying member.

3. A can opener as claimed in claim 2 wherein the blade-carrying member is provided with a hook and the housing with a pin.

4. A can opener as claimed in claim 2 wherein the blade-carrying member is provided with one or more axles and the housing with slots adapted to receive the or each axle.

5. A can opener as claimed in claim 1 wherein the projection and the recess are provided on the blade-carrying member and the housing respectively.

6. A can opener as claimed in claim 1 and further including a post extending from the housing, said post being slidable in a sleeve attached to a work surface or table.

7. A can opener as claimed in claim 1 wherein the actuation means includes a cam follower engageable with the blade-carrying member, the cam follower being movable by a cam surface of the actuation means to effect pivotal movement of the blade-carrying member relative to the housing.

8. A can opener as claimed in claim 7 wherein the blade-carrying member is provided with spaced arms, and the cam follower is provided with a recess adapted to receive said arms.

9. A can opener as claimed in claim 7 wherein the blade-carrying member is provided with spaced arms, and the cam follower is provided with spaced recesses adapted to receive said arms.

10. A can opener as claimed in claim 7 and including a spring provided between the housing and the cam follower.

11. A can opener as claimed in claim 10 wherein the cam follower includes a recess adapted to receive the spring.

12. A can opener as claimed in claim 7 wherein the stop means comprise a projection of the blade-carrying member and a recess of the cam follower.

13. A can opener as claimed in claim 7 wherein the cam follower is annular.

14. A can opener as claimed in claim 13 wherein the cam follower is substantially cylindrical.

15. A can opener operable in use to rotate a container relative to a blade of the can opener, the can opener comprising a housing, a blade-carrying member releasably connected to the housing and pivotable relative thereto, and actuation means operable to pivot said blade-carrying member and to rotate a container, the actuation means including a cam follower engageable with the blade-carrying member and a spring, the cam follower being movable by a cam surface of the actuation means to effect pivotal movement of the blade-carrying member relative to the housing, and the spring being provided between the cam follower and the housing, wherein a hooked connection is provided between the blade-carrying member and the housing, said hooked connection being separable so as to enable the blade-carrying member to be removed from the housing when the actuation means is moved to a release position.

16. A can opener as claimed in claim 15 wherein the hooked connection comprises a hook on one of the housing and the blade-carrying member and a pin or axle of the other of the housing and the blade-carrying member.

17. A can opener as claimed in claim 16 wherein the blade-carrying member is provided with a hook and the housing with a pin.

18. A can opener as claimed in claim 16 wherein the blade-carrying member is provided with one or more axles and the housing with slots adapted to receive the or each axle.

19. A can opener as claimed in claim 15 and including stop means to prevent the separation of the hooked connection unless the actuation means is in the release position.

20. A can opener as claimed in claim 19 wherein the stop means comprise a projection on one of the housing and the blade-carrying member and a recess in the other of the housing and the blade-carrying member.

21. A can opener as claimed in claim 20 wherein the projection and the recess are provided on the blade-carrying member and the housing respectively.

22. A can opener as claimed in claim 19 wherein the stop means comprise a projection of the blade-carrying member and a recess of the cam follower.

23. A can opener as claimed in claim 15 wherein the cam follower includes a recess adapted to receive the spring.

24. A can opener as claimed in claim 15 wherein the blade-carrying member is provided with spaced arms, and the cam follower is provided with spaced recesses adapted to receive said arms.

25. A can opener as claimed in claim 15 and further including a post extending from the housing, said post being slidable in a sleeve attached to a work surface, or table.

* * * * *